US011986101B2

(12) United States Patent
Koltzenburg et al.

(10) Patent No.: US 11,986,101 B2
(45) Date of Patent: May 21, 2024

(54) LUMBAR SUPPORT DEVICE FOR AN ITEM OF SEATING FURNITURE AND SEATING FURNITURE WITH A LUMBAR SUPPORT DEVICE

(71) Applicant: DEWERTOKIN TECHNOLOGY GROUP CO. LTD, Jiaxing (CN)

(72) Inventors: Sascha Koltzenburg, Preussisch Oldendorf (DE); Matthew Wafler, Tupelo, MS (US)

(73) Assignee: Dewertokin Technology Group Co., Ltd, Jiaxing (CN)

( * ) Notice: Subject to any disclaimer, the term of this patent is extended or adjusted under 35 U.S.C. 154(b) by 215 days.

(21) Appl. No.: 17/312,318

(22) PCT Filed: Dec. 6, 2019

(86) PCT No.: PCT/EP2019/084075
§ 371 (c)(1),
(2) Date: Jun. 9, 2021

(87) PCT Pub. No.: WO2020/120336
PCT Pub. Date: Jun. 18, 2020

(65) Prior Publication Data

US 2022/0022655 A1 Jan. 27, 2022

(30) Foreign Application Priority Data

Dec. 10, 2018 (DE) ..... 20 2018 107 033.9

(51) Int. Cl.
*A47C 7/46* (2006.01)

(52) U.S. Cl.
CPC ..... *A47C 7/462* (2013.01)

(58) Field of Classification Search
CPC ..... A47C 7/462
USPC ..... 297/284.4
See application file for complete search history.

(56) References Cited

U.S. PATENT DOCUMENTS

| | | | | |
|---|---|---|---|---|
| 4,295,681 A | | 10/1981 | Gregory | |
| 4,313,637 A | * | 2/1982 | Barley | A47C 7/462 297/284.4 |
| 4,678,230 A | | 7/1987 | Winkle | |
| 4,762,367 A | * | 8/1988 | Denton | B60N 2/838 297/391 |
| 5,553,919 A | * | 9/1996 | Dennis | A47C 7/462 297/284.8 |

(Continued)

FOREIGN PATENT DOCUMENTS

KR 100 462 492 12/2004

OTHER PUBLICATIONS

International Search Report issued by the European Patent Office in International Application PCT/EP2019/084075 dated Jan. 7, 2020.

*Primary Examiner* — Rodney B White
(74) *Attorney, Agent, or Firm* — Henry M. Feiereisen LLC

(57) ABSTRACT

A lumbar support device for an item of seating furniture, in particular an armchair, includes an electromotive linear drive including a guide profile and two sliding blocks movable on the guide profile in synchronism towards one another and away from one another. Each sliding block includes a spindle nut coupled by a spindle. The linear drive is coupled to an extendable support element via a lever mechanism which includes levers connecting the sliding blocks to the support element, respectively.

11 Claims, 7 Drawing Sheets

(56) References Cited

U.S. PATENT DOCUMENTS

| | | | | |
|---|---|---|---|---|
| 5,769,490 | A * | 6/1998 | Falzon | B60N 2/6671 297/284.4 X |
| 7,488,039 | B2 * | 2/2009 | Fischer | B60N 2/0232 297/284.4 |
| 7,690,727 | B2 * | 4/2010 | Fischer | B60N 2/6673 297/284.4 |
| 8,091,966 | B2 * | 1/2012 | Schweizer | B60N 2/0232 297/284.7 |
| 8,091,967 | B2 * | 1/2012 | Schweizer | B60N 2/6671 297/284.7 |
| 8,323,344 | B2 * | 12/2012 | Galley | A61B 17/7065 254/122 |
| 8,474,909 | B2 * | 7/2013 | LaPointe | A47C 7/462 297/284.4 |
| 2006/0290189 | A1 | 12/2006 | Hsiao | |
| 2012/0068508 | A1 | 3/2012 | LaPointe et al. | |
| 2016/0250957 | A1 | 9/2016 | Yoo | |

* cited by examiner

LUMBAR SUPPORT DEVICE FOR AN ITEM OF SEATING FURNITURE AND SEATING FURNITURE WITH A LUMBAR SUPPORT DEVICE

CROSS-REFERENCES TO RELATED APPLICATIONS

This application is the U.S. National Stage of International Application No. PCT/EP2019/084075, filed Dec. 6, 2019, which designated the United States and has been published as international Publication No. WO 2020/120336 A1 and which claims the priority of German Patent Application, Serial No. 20 2018 107 033.9, filed Dec. 10, 2018, pursuant to 35 U.S.C. 119(a)-(d).

BACKGROUND OF THE INVENTION

The invention relates to a lumbar support device for an item of seating furniture having an electric motor drive. The invention further relates to an item of seating furniture, in particular an armchair, having such a lumbar support device.

Lumbar support devices are known, for example, from seating furniture, such as chairs, especially office chairs and armchairs. Lumbar support devices are intended to support the natural abdominal curvature of the lumbar spine of a user of the seating furniture. In addition to static lumbar support devices, which are incorporated in the form of corresponding curvatures in a backrest of the seating furniture, adjustable lumbar support devices are known, the support effect of which can be adjusted by extending a support element more or less far in the direction of the users back. Electromotively operated lumbar supports are particularly common for larger items of furniture with correspondingly more voluminous upholstery, i.e. especially for armchairs.

A known embodiment of such an electromotively extendable lumbar support device uses a profile rail extending horizontally transversely behind the backrest upholstery, on which two sliding elements are guided so that they can be moved toward and away from each other. The sliding elements are connected to a v-shaped lever mechanism in such a way that when the sliding elements are moved towards each other, a tip of the v-shaped lever mechanism moves in the direction of the back upholstery. A flat support element is formed at this tip of the v-shaped lever mechanism, which acts as a lumbar support element via the upholstery.

In order to move the two sliding elements synchronously towards each other, an electric motor drive is used, usually a linear drive, which is coupled to the two sliding elements via a further lever mechanism. This further lever mechanism use uses, among other things, a lever on both sides to enable movement in the different directions, i.e. toward or away from each other.

It is an object of the present invention to describe a lumbar support device of the type mentioned at the beginning, which is driven by an electric motor and has a simpler and thus more cost-effective and maintenance-free structure. It is a further object to create an item of seating furniture having an easily mountable lumbar support device.

SUMMARY OF THE INVENTION

This object is solved by a lumbar support device and an item of seating furniture having the features of the respective independent claim. Advantageous designs and further developments are the subject matter of the dependent claims.

BRIEF DESCRIPTION OF THE DRAWING

The invention is explained in more detail below by means of an exemplary embodiment by means of the figures, wherein.

DETAILED DESCRIPTION OF PREFERRED EMBODIMENTS

Figure 1A:
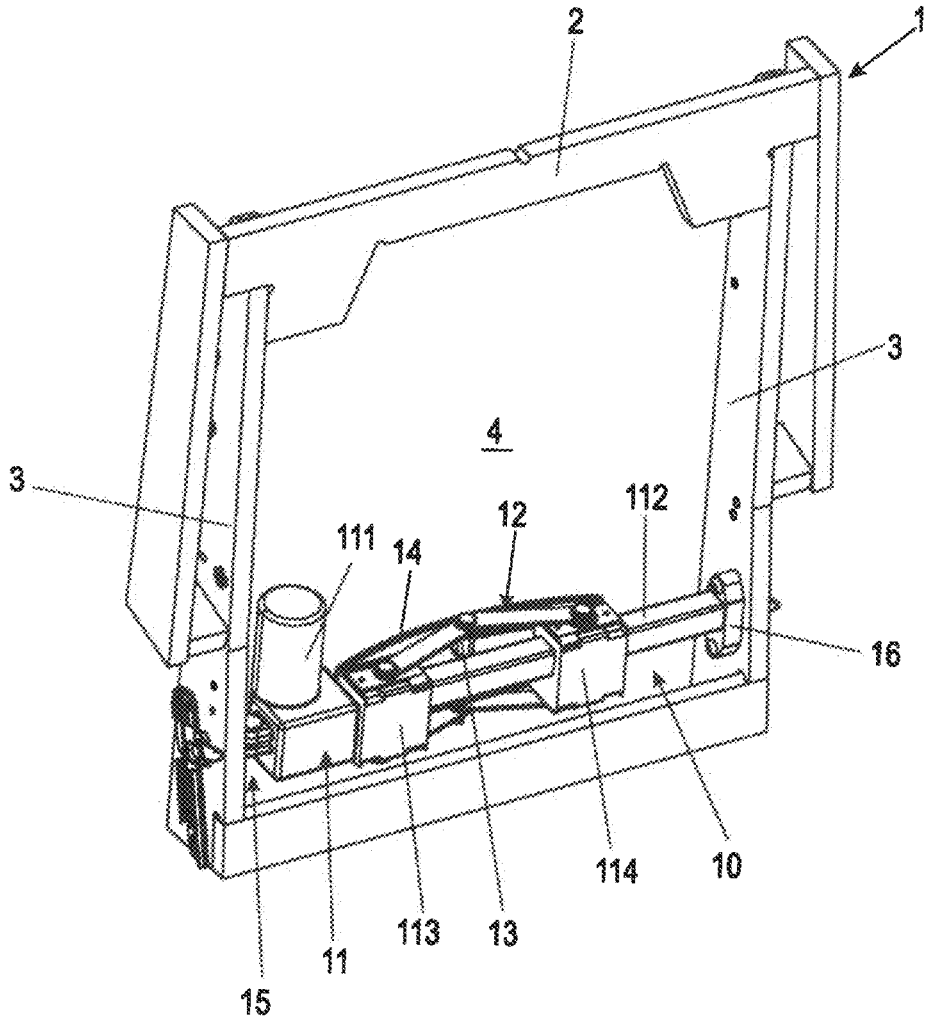
FIGS. 1*a, b* each show an isometric view of a rear side of a partially depicted item of seating furniture having a lumbar support device from different viewing directions.
Figure 1B:
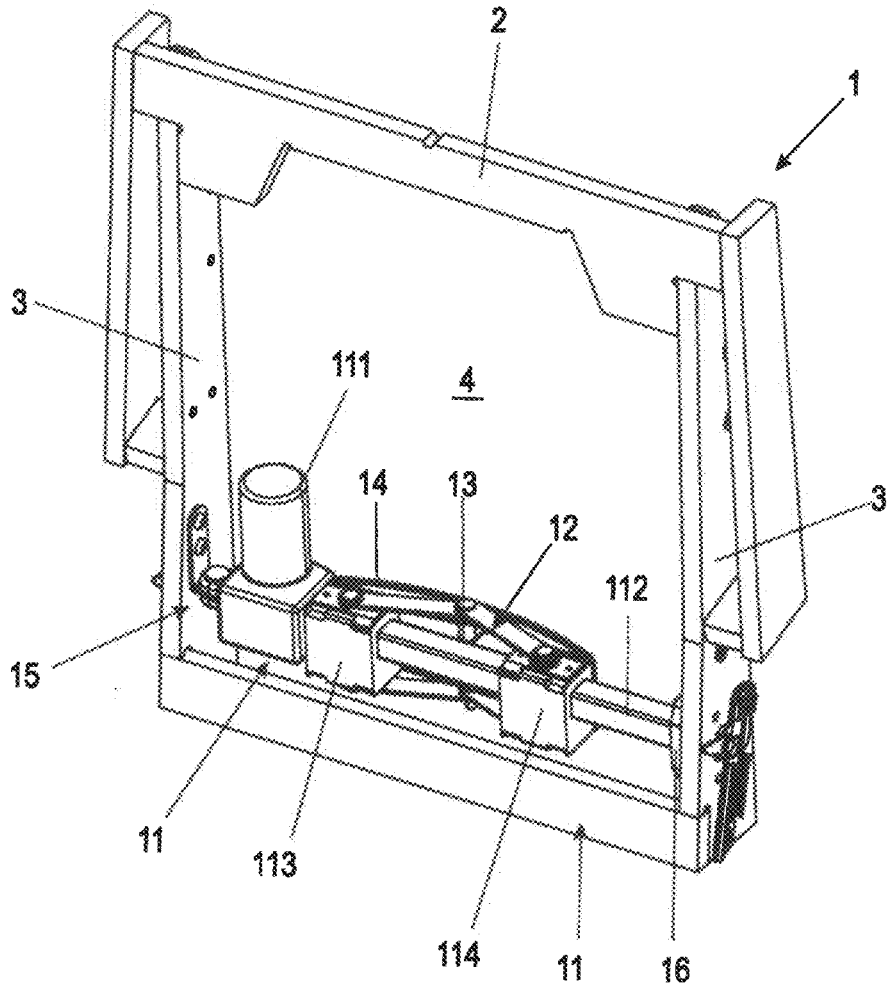

FIGS. 1*a* and 1*b* each show an isometric view of a back part 1 of an otherwise not further shown armchair as an example of seating furniture. The side of the back part 1 facing the viewer in the figures is the rear side of the seating furniture facing away from the seat surface (not shown here). It is usually covered with a stretched cloth or similar upholstery fabric.

The back part 1 has a frame 2 that comprises two side cheeks 3. On the side facing away from the user in FIGS. 1*a* and 1*b*, the frame 2 defines an upholstered surface plane 4. An upholstered layer of the back part is arranged on this plane, optionally supported by transverse support elements.

A lumbar support device 10 according to the application is installed in the lower region of the frame 2 and thus also in the lower region of the upholstered surface plane 4. This comprises a linear drive 11, which in turn has a motor and gear unit 111 and a guide profile 112 attached thereto. On the side of the motor and gear unit 111, the lumbar support device 10 is mounted in a motor-side fastening element 15 on one of the side cheeks 3, and on the opposite side it is mounted with the end of its guide profile 112 in a guide-profile-side fastening element 16 on the opposite side cheek 3.

In the example shown, the guide profile 112 is a square profile on which two sliding blocks 113, 114 with corresponding openings are placed, which can be moved horizontally on the guide profile 112 accordingly. The guide profile 112 is open to one side, for example downwards or forwards (i.e. in the direction of the seat surface of the chair), wherein a respective section of the sliding blocks 113, 114 projects into the interior of the guide profile 112.

Inside the guide profile 112, a spindle rotatably driven by the motor and gear unit 111 extends along substantially the entire length of the guide profile 112. The spindle engages in spindle nuts that are non-rotatably connected to or integral with the slide blocks 113, 114.

As a special feature in the illustrated linear drive 11, the spindle has two threaded sections which are provided with differently oriented threads, i.e. with a left-hand thread in a first spindle section and a right-hand thread in a second spindle section. The spindle sections correspond respectively to the range of movement of the sliding blocks 113, 114, whose spindle nut is also formed with left-hand and right-hand threads. As a result of this arrangement, when the spindle rotates, the sliding blocks 113, 114 move towards each other and away from each other, respectively. Due to the same thread pitch in the two spindle sections mentioned, this movement is synchronous, as will be explained in more detail in connection with FIGS. 2*a* and 2*b*.

The lumbar support device 10 further comprises a lever mechanism 12, via which the sliding blocks 113, 114 act on a common axle 13. In each case, two levers, one on the upper side, one on the lower side of the sliding blocks 113, 114 are arranged between the respective sliding block 113, 114 and the axle 13. A triangular arrangement is thus formed between the sliding blocks 113, 114 and the axle 13. A support element 14 is fastened to the axle 13, which rests with a support surface against the upholstery of the back part not shown here and which is moved in the direction of the upholstery layer or into the upholstery layer in accordance with the movement of the sliding blocks 113, 114.

Figure 2A:
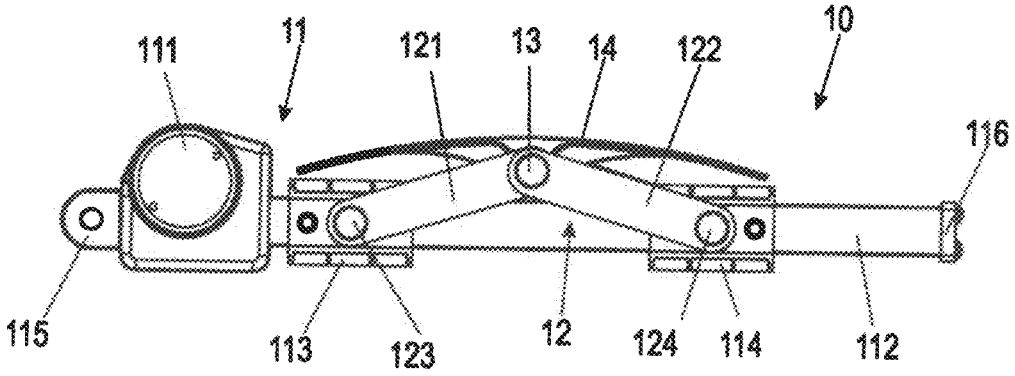
FIGS. 2*a, b* show a top view of the lumbar support device of FIG. 1*a, b* in various operating positions.
Figure 2B:
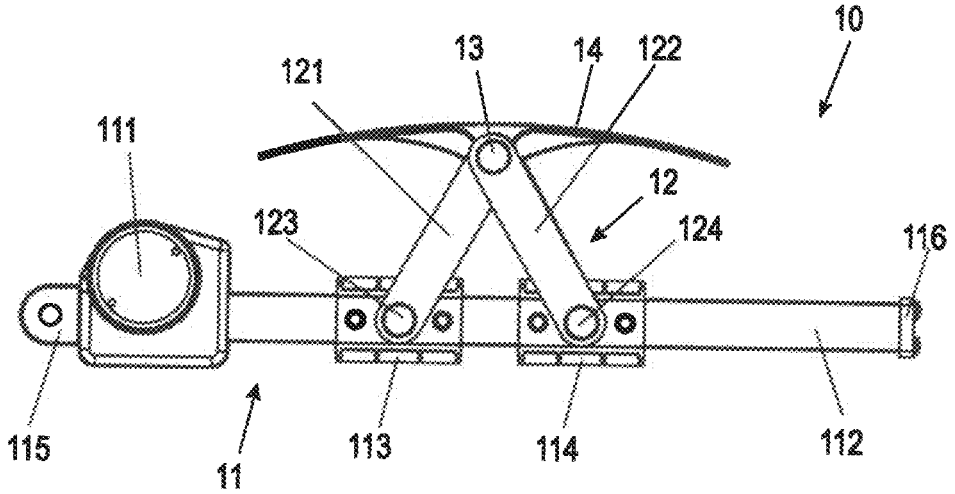

In FIGS. 2*a* and 2*b*, the lumbar support device 10 used in the chair according to FIGS. 1*a* and 1*b* is shown in more detail and separately from the back part 1 in a top view in each case. In FIG. 2*a*, the support element 14 of the lumbar support device 10 is retracted and in FIG. 2*b* it is extended substantially to the maximum.

The comparison of the two figures shows the synchronous movement of the sliding blocks 113, 114 towards and away from each other. In the figures, the two upper levers 121, 122, which connect the respective sliding block 113, 114 to the axle 13, are shown separately from the lever mechanism 12. The levers 121, 122 are pivotally mounted on the sliding blocks 113, 114 in pivot bearings 123, 124. The lower levers move congruently with the upper levers 121, 122 shown and are therefore not visible in the illustration of FIGS. 2*a* and 2*b*. Due to the synchronous movement of the sliding blocks 113, 114, the axle 13 moves along a line perpendicular to the guide profile 112.

It can further be seen in FIGS. 2*a* and 2*b* that the support element 14, which presses into the upholstery of the back part 1 as it moves, is curved to avoid uncomfortably protruding edges in the user's back area.

In the illustrated exemplary embodiment, the motor and gear unit 111 is arranged on one side of the guide profile 112. In alternative designs, it is conceivable that the motor and gear unit 111 is arranged centrally or approximately centrally so that sections of the guide profile 112 extend to both sides of the motor and gear unit. One of the sliding blocks 113, 114 is guided on each of the sections. A first spindle (or first spindle section) with a left-hand thread then projects from the motor and gear unit 111 into one guide profile section, and a second spindle (or second spindle section) with a right-hand thread projects into the other guide profile section. This can be two independent spindles or one continuous spindle. If two separate spindles are used, both spindles can also be formed with the same thread type, i.e. both with right-hand thread or both with left-hand thread, in which case the spindles are rotated synchronously in different directions by the motor and gear unit 111.

In the illustrated design and also in the described alternative designs, the motor and gear unit 111 may include an electric motor with a worm, wherein a worm wheel disposed on the one or more spindles is driven by the motor via said worm.

The lumbar support device 10 shown in FIGS. 1*a, b* and 2*a, b* does not require any levers or devices other than the levers 121, 122 of the lever mechanism 12 that serve a synchronous movement of the sliders 113, 114. Accordingly, a compact structure is achieved. The fact that there are no further moving elements also reduces a risk of pinching or crushing with respect to objects that could be pressed into the region of the lumbar support device 10 by the cover of the back part 1, which is not visible in FIGS. 1*a* and 1*b*.

The lumbar support device 10 shown can also be mounted in the frame 2 according to FIGS. 1*a* and 1*b* in a very simple manner. For mounting, the lumbar support device 10 has a fastening fork head 115 on the motor side. At the opposite end, the guide profile 112 is closed with a profile end cap 116. In the frame 2, only one motor-side fastening element 15 and one guide-profile-side fastening element 16 are to be attached to each of the two opposite side cheeks 3, into which the lumbar support device 10 is inserted and fastened. Details on the assembly of the lumbar support device 10 are explained below in connection with FIGS. 3*a* to 6*b*.

Figure 3C:
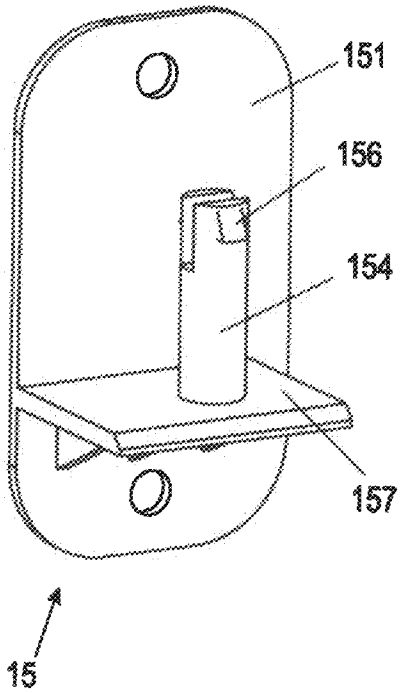
FIGS. 3*a*-3*c* show three different designs of a motor-side fastening element for a lumbar support device.
Figure 3B:
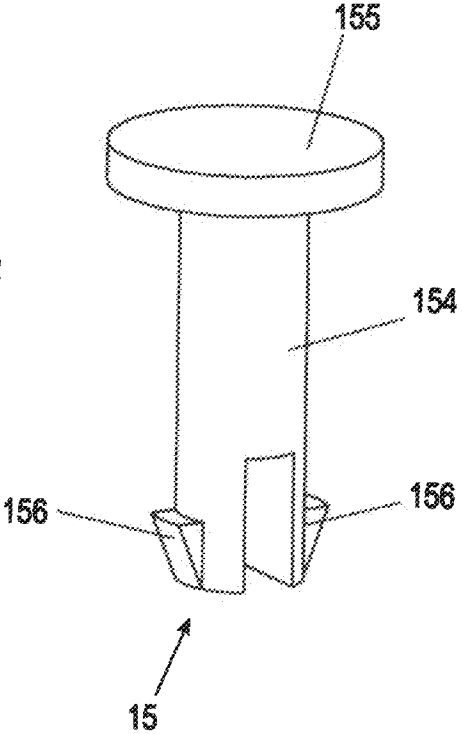
Figure 3A:
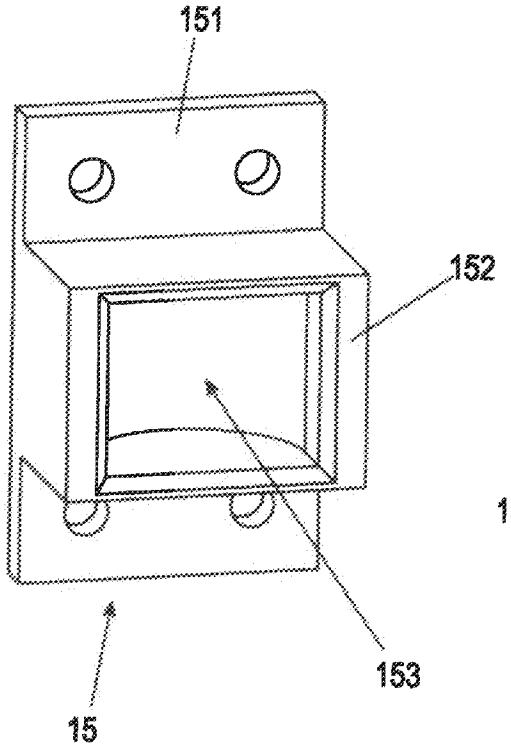

In FIGS. 3*a*-3*c*, three designs of motor-side fasteners 15 are shown in more detail, each in an isometric view.

FIG. 3*a* shows a first exemplary embodiment in which a frame-shaped attachment 152 is arranged or formed on a mounting plate 151. The frame-shaped attachment 152 circumscribes a semi-cylindrical recess 153.

The motor-side fastening element 15 shown is screwed onto one of the side cheeks in a simple manner with its mounting plate 151 using, for example, wood screws. For mounting, the lumbar support device 10 is inserted with its motor-side fastening fork head 115, wherein the end profile end cap 116 of the guide profile 112 is still held outside the back part 1. After insertion into the motor-side fastening element 15, the lumbar support device 10 can then be swiveled into the correct position. This is described in more detail still in connection with exemplary embodiments of the guide-profile-side fastening element 16 in FIGS. 4*a, b*, 5*a, b* and 6*a, b*.

FIG. 3*b* shows another design for the motor-side fastening. As can be seen in FIGS. 2*a* and 2*b*, the motor-side fastening fork head 115 has a central bore that is vertical in the installation position. Therefore, a bracket with an eyelet projecting at right angles from the side cheek 3 can be used for fastening to the side cheek 3, which is also visible in FIG. 1*b*. A bore of the eyelet as well as the bores of the fastening fork head 115 are brought into alignment with each other and a fastening pin 154, as shown in FIG. 3*b*, is inserted.

The fastening pin 154 has a laterally projecting head 155 at one end and latching elements 156 at the opposite end. The latching elements 156 are formed as latching lugs, for example, as shown, wherein a notch in the fastening pin 154 allows the latching elements 156 to be pressed in. The fastening pin 154 can be inserted from above into the bore of the fastening fork head 115 and latches without tools, thereby fixing the lumbar support device 10, which can then be inserted into the opposite guide-profile-side fastening element 16 in a horizontally pivoted manner as described in connection with FIG. 3.

A third configuration of a motor-side fastening element 15 is shown in FIG. 3*c*. This again has a mounting plate 151 on which a projecting bracket 157 is formed. A fastening pin 154 is mounted on the bracket 157 or formed integrally with the bracket 157, which is substantially the same as that shown in FIG. 3*b* except for the head 155. This fastening pin 154 also has latching elements 156 at its end, in this case the upwardly projecting free end. The lumbar support device 10 can be slipped onto the pin 154 with its fastening fork head 115 until the latching elements 156 engage. After that, the previously described pivoting into the guide-profile-side fastening element 16 takes place again.

Figure 4B:
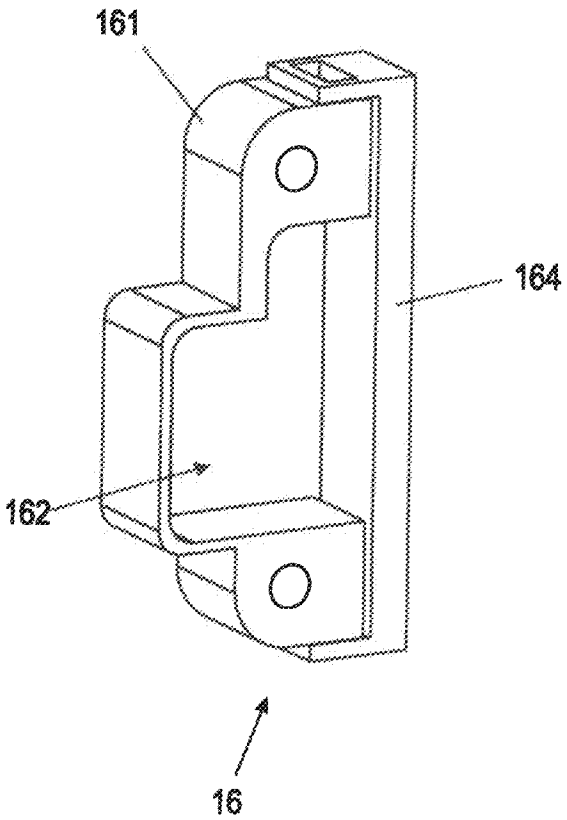
FIGS. 4*a, b*, 5*a, b*, 6*a, b* show three different designs of guide-profile-side fastening elements for a lumbar support device in each case in an open and a closed state.
Figure 4A:
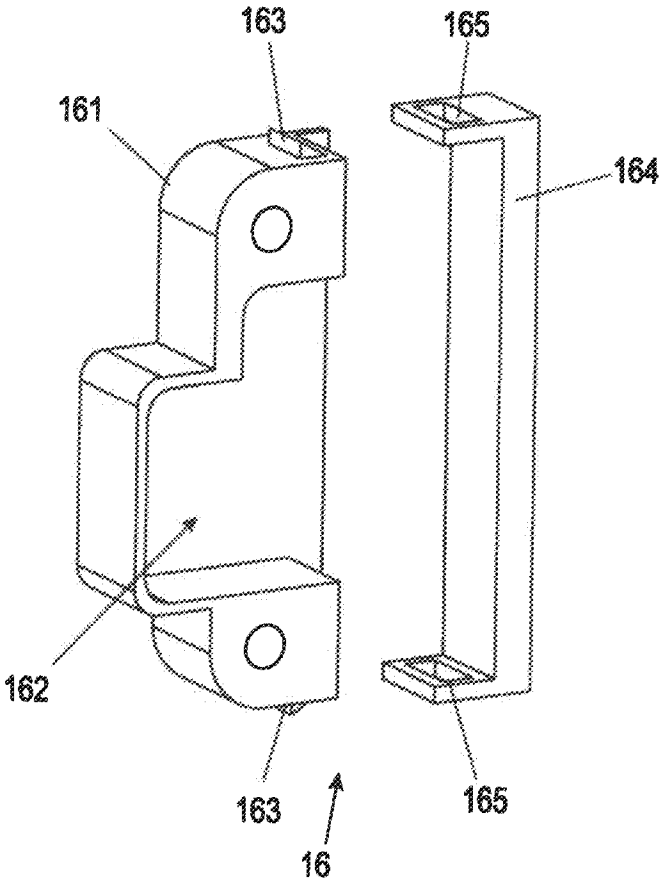

In FIGS. 4*a, b*, 5*a, b* and 6*a, b*, three different designs of a guide-profile-side fastening element 16 for the previously shown lumbar support device 10 are reproduced in isometric representations. The figures with the suffix "a" show the guide-profile-side fastening element 16 in each case in an open state, and the figures with the suffix "b" in a closed state.

In a first example according to FIGS. 4*a, b*, the guide-profile-side fastening element 16 has a base body 161 that can be screwed to the side cheek 3 of the back part 1 by means of screws through fastening holes. A receptacle 162 is formed on the base body 161, which is perpendicular to the side cheek 3 and open towards the rear (with respect to the back part 1). The end of the guide profile 112 with the profile end cap 116 can be inserted, in particular pivoted, into this receptacle 162. After insertion or pivoting in, a locking bolt 164 is placed on the base body 161, which then fixes the guide profile 112 in the mounting position of the lumbar support device 10. Latching elements 163 are formed on the base body 161, in this case with latching lugs, in which the locking bolt 164 engages with openings 165. The latching connection can be released by hooking it under, for example with a screwdriver, if the lumbar support device 10 has to be removed again.

Figure 5B:
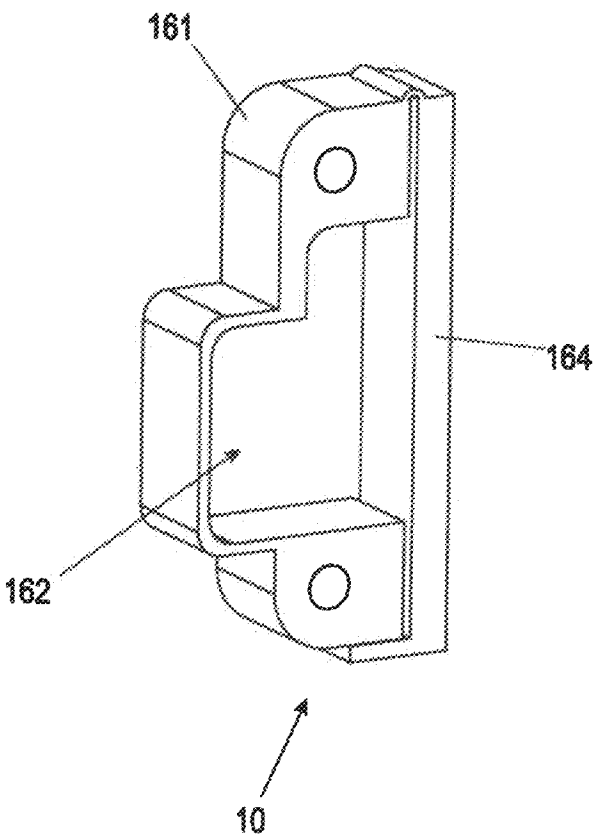
Figure 5A:
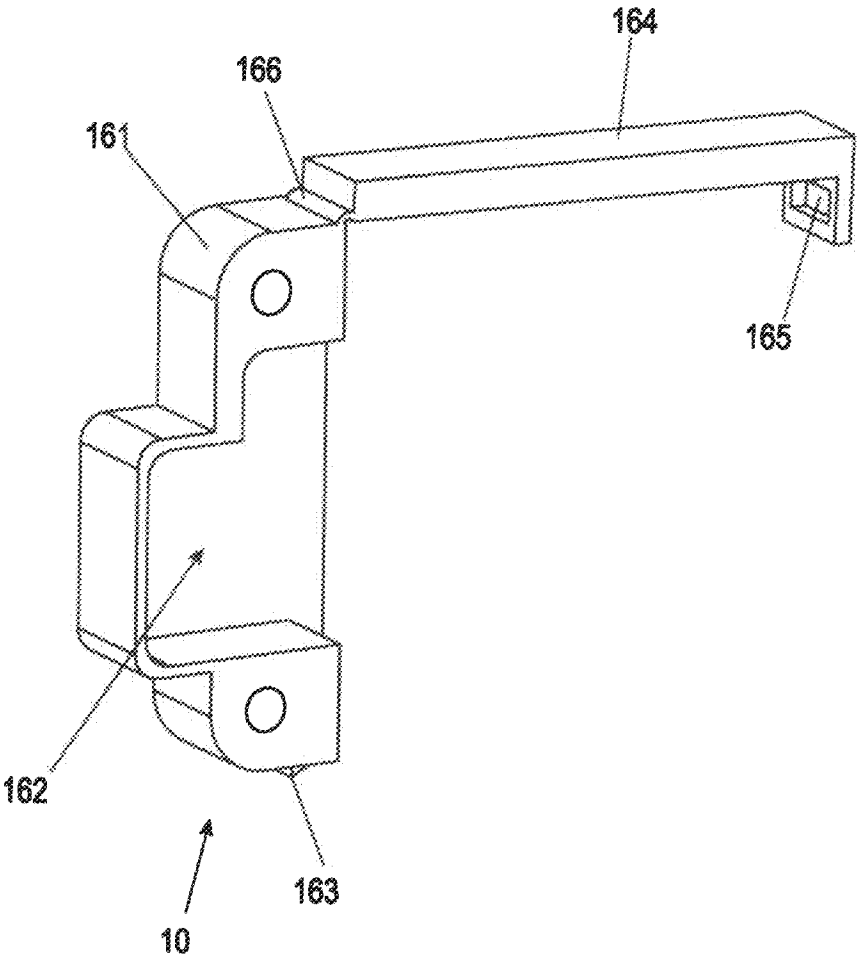

The second embodiment of a guide-profile-side fastening element 16 shown in FIGS. 5*a* and 5*b* corresponds in its basic structure to that shown in FIGS. 4*a, b*. In contrast, the locking bolt 164 is connected to the base body 161 at one side via a hinge 166, preferably a film hinge. The guide-profile-side fastening element 16 can thus preferably be manufactured in one piece, for example in a plastic injection molding process. To close the fastening element 16, the locking bolt 164 is pivoted until it latches on the side opposite the hinge 166, which in turn is carried out by a combination of latching element 163 and opening 165.

Figure 6B:
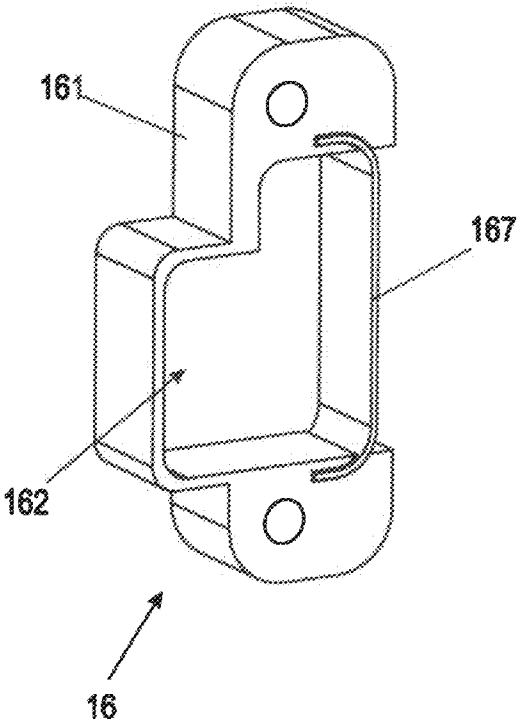
Figure 6A:
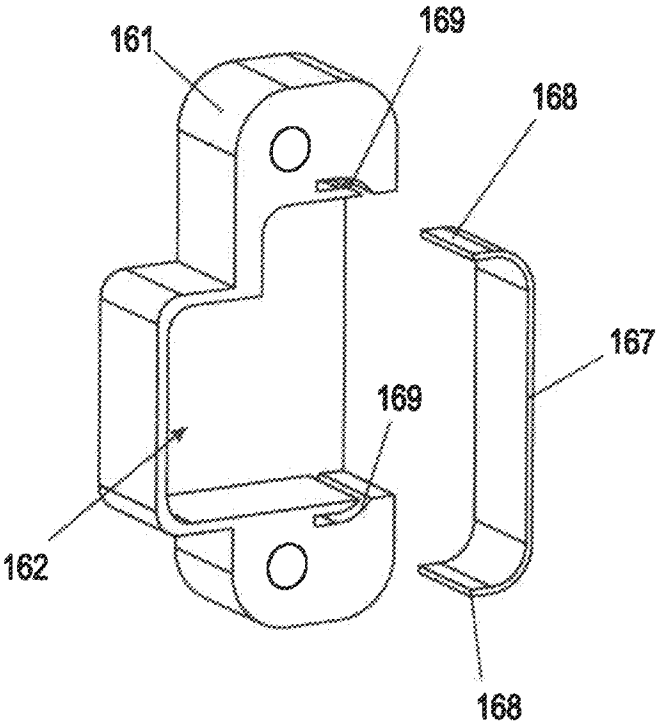

A third design of a guide-profile-side fastening element 16 is shown in FIGS. 6*a* and 6*b*. Again, the base body 161 is formed comparable to the previously described exemplary embodiments. Also provided is a locking element comparable to the locking bolt 164, which in this exemplary embodiment is formed as a metallic dip 167 with bent end sections 168. Slots 169 are made in the base body 161 for receiving the clip 167, into which the clip 167 is inserted. The direction of insertion is in the longitudinal direction of the guide profile 112. In a direction transverse thereto, i.e. in the direction in which the guide profile 112 is pivoted in, the clip is secured by positive locking by being pushed into the slots 169.

What is claimed is:

1. A lumbar support device for an item of seating furniture, said lumbar support device comprising:

an electromotive linear drive including a guide profile and two sliding blocks movable on the guide profile in synchronism towards one another and away from one another, each said sliding block including a spindle nut coupled by a spindle;

an extendable support element;

a lever mechanism configured to couple the electromotive linear drive to the extendable support element, said lever mechanism including levers connecting the sliding blocks to the support element, respectively, wherein the linear drive comprises a motor and gear unit operably connected to the spindle for driving the spindle and wherein the guide profile is attached to the motor and gear unit;

a fastening fork head on a motor side; and a profile end cap that closes the guide profile at an end opposite the motor and gear unit; wherein the fastening fork head and the profile end cap are configured for pivoting installation of the lumbar support device in the item of seating furniture.

2. The lumbar support device of claim 1, wherein the spindle includes two sections, one of the sections being provided with a left-hand thread and interacting with one of the sliding blocks, and another one of the sections being provided with a right-hand thread and interacting with another one of the sliding blocks.

3. The lumbar support device of claim 1, wherein the guide profile includes two sections between which the motor and gear unit is arranged, with one of the sections guiding one of the sliding blocks, and with another one of the sections guiding another one of the sliding blocks.

4. The lumbar support device of claim 1, wherein the levers of the lever mechanism are arranged in a v-shaped arrangement, with one of the levers rotatably mounted at one end to one of the sliding blocks, and with another one of the levers rotatably mounted at one end to another one of the sliding blocks, said levers being rotatably hinged at their other end to the support element.

5. The lumbar support device of claim 4, wherein the v-shaped arrangement of the levers is provided on opposite sides of each of the sliding blocks.

6. A seating furniture comprising:

a back part; and a lumbar support device operably connected to the back part, said lumbar support device comprising a linear drive including a guide profile and two sliding blocks movable on the guide profile in synchronism towards one another and away from one another, each said sliding block including a spindle nut coupled by a spindle, wherein the lumbar support device includes an extendable support element, and a lever mechanism configured to couple the linear drive to the extendable support element, said lever mechanism including levers connecting the sliding blocks to the support element, respectively, wherein the linear drive comprises a motor and gear unit operably connected to the spindle for driving the spindle, and wherein the guide profile is attached to the motor and gear unit, the back part includes two side cheeks between which the linear drive of the lumbar support device is arranged, the lumbar support device includes a motor-side fastening element which is mounted on one of the side cheeks, said linear drive being pivotally fastened with a motor-side fastening fork head of the lumbar support device, and the lumbar support device includes a guide-profile side fastening element which is mounted on another one of the side cheeks, said guide profile of the linear drive having a profile end cap which is pivotable and fastenable in the guide-profile-side fastening element.

7. The seating furniture of claim 6, wherein the seating furniture is an armchair.

8. The seating furniture of claim 6, wherein the spindle includes two sections, one of the sections being provided with a left-hand thread and it with one of the sliding blocks, and another one of the sections being provided with a right-hand thread and interacting with another one of the sliding blocks.

9. The seating furniture of claim 6, wherein the guide profile includes two sections between which the motor and gear unit is arranged, with one of the sections guiding one of the sliding blocks, and with another one of the sections guiding another one of the sliding blocks.

10. The seating furniture of claim 6, wherein the guide profile is closed at an end opposite the motor and gear unit with the profile end cap.

11. The seating furniture of claim 1, wherein the seating furniture is an armchair.

* * * * *